US010428494B1

(12) United States Patent
Lombardo et al.

(10) Patent No.: US 10,428,494 B1
(45) Date of Patent: Oct. 1, 2019

(54) WEAR PLATE ASSEMBLY WITH TWO-PART KEY ASSEMBLY

(71) Applicants: Pasquale Lombardo, Phoenix, AZ (US); Gaetano Lombardo, Phoenix, AZ (US)

(72) Inventors: Pasquale Lombardo, Phoenix, AZ (US); Gaetano Lombardo, Phoenix, AZ (US)

( * ) Notice: Subject to any disclaimer, the term of this patent is extended or adjusted under 35 U.S.C. 154(b) by 0 days.

(21) Appl. No.: 16/213,763

(22) Filed: Dec. 7, 2018

(51) Int. Cl.
*E02F 9/28* (2006.01)

(52) U.S. Cl.
CPC ..... *E02F 9/2883* (2013.01)

(58) Field of Classification Search
CPC ..... E02F 3/8152; E02F 3/8155; E02F 9/2816; E02F 9/2833; E02F 9/2883
USPC ..... 37/446, 445.1, 452–460; 172/701.1–701.3, 772
See application file for complete search history.

(56) References Cited

U.S. PATENT DOCUMENTS

| | | | | |
|---|---|---|---|---|
| 4,086,712 | A | 5/1978 | McReynolds | |
| 4,128,132 | A | 12/1978 | Moen et al. | |
| 4,129,952 | A | 12/1978 | Olson | |
| 4,315,375 | A | 2/1982 | Shinn | |
| 4,716,666 | A | 1/1988 | Potter | |
| RE33,454 | E | 11/1990 | Potter | |
| 5,005,304 | A | 4/1991 | Briscoe et al. | |
| 5,055,336 | A | 10/1991 | Davis | |
| 5,056,243 | A | 10/1991 | Sprunger et al. | |
| 5,063,695 | A | 11/1991 | Briscoe et al. | |
| 5,088,214 | A | 2/1992 | Jones | |
| 5,129,168 | A | 7/1992 | Hedley | |
| 5,203,513 | A | 4/1993 | Keller et al. | |
| 5,241,765 | A | 9/1993 | Jones et al. | |
| 5,634,285 | A | 6/1997 | Renski | |
| 5,666,748 | A | 9/1997 | Emrich et al. | |
| 5,913,605 | A | 6/1999 | Jusselin et al. | |
| 5,937,549 | A | 8/1999 | Bender et al. | |
| 6,030,143 | A | 2/2000 | Kreitzberg | |
| 6,041,529 | A | 3/2000 | Ruvang | |
| 6,194,080 | B1 | 2/2001 | Stickling | |
| 7,144,183 | B2 | 12/2006 | Lian et al. | |
| 7,367,144 | B2 | 5/2008 | Jones et al. | |
| 7,712,234 | B2 | 5/2010 | Striegel | |
| 7,770,310 | B2 * | 8/2010 | Keech | E02F 3/8155 37/455 |
| 8,561,326 | B2 * | 10/2013 | Ruvang | E02F 9/2883 37/452 |

(Continued)

*Primary Examiner* — Robert E Pezzuto
(74) *Attorney, Agent, or Firm* — Thomas W. Galvani, P.C.; Thomas W. Galvani

(57) ABSTRACT

A wear plate assembly includes a base having a slot with an enlarged aperture, and a wear plate having a wear surface and a hold recessed below the wear surface. The wear plate moves between a free condition and an applied condition covering the base. The assembly includes a nut and a key. The nut has a bore to receive the key, and is applicable through the aperture into the slot. The nut moves between a first position registered in the aperture and a second position offset from the aperture where the nut is captured under the base. In the applied condition of the wear plate and the second position of the nut, the bore is registered with the slot and the hold to define a keyway, and the key is applicable to the keyway for engagement with the nut to secure the wear plate on the base.

21 Claims, 12 Drawing Sheets

(56) References Cited

U.S. PATENT DOCUMENTS

| | | | | |
|---|---|---|---|---|
| 10,030,367 | B2 * | 7/2018 | Dare | E02F 3/40 |
| 2007/0044349 | A1 | 3/2007 | McClanahan et al. | |

* cited by examiner

WEAR PLATE ASSEMBLY WITH TWO-PART KEY ASSEMBLY

FIELD OF THE INVENTION

The present invention relates generally to heavy machinery equipment, and more particularly to protective equipment for heavy machinery equipment.

BACKGROUND OF THE INVENTION

Heavy machinery equipment are used in excavation, demolition, construction, and similar activities. The parts of heavy machines used for digging are exposed to a great amount of wear in operation. For instance, the bucket of an excavator can be used to dig, rip, crush, cut, or lift dirt, rock, concrete, metal, or other rugged materials, all of which constantly wear against and abrade the surface of the excavator's bucket.

Heavy machinery parts are expensive and time-consuming to maintain. To replace a worn bucket on an excavator, for example, a new bucket must be ordered and shipped, the excavator must be taken out of operation, the old bucket must be removed, and the new one must be installed. This requires significant time and effort, and workers are often injured during the replacement process, which usually involves sledgehammers and blowtorches.

Various attempts have been made to protect heavy machinery parts to avoid having to replace an entire part. For instance, there are abrasive wear elements that can be secured to the surface of an excavator bucket to protect that surface. However, many of these elements are welded or bolted on to the surface of the machinery part and can be difficult to replace once worn through. In wear elements which have bases and attachable wear plates, when the abrasive wear plate is worn, the engagement means securing the base to the surface is often also damaged and cannot be removed, which requires that the entire base be ground or cut off and replaced. An improved system for protecting heavy machinery equipment is needed.

SUMMARY OF THE INVENTION

A wear plate assembly includes a base having a slot formed with an enlarged aperture, and a wear plate having a wear surface and a hold recessed below the wear surface. The wear plate moves between a free condition off the base and an applied condition covering the base. The assembly also includes a nut and a key. The nut is formed with a bore to receive the key, and is applicable through the aperture into the slot. The nut is then moved from a first position registered in the aperture and a second position offset from the aperture where the nut is captured under the base. In the applied condition of the wear plate and the second position of the nut, the bore is registered with the slot and the hold to define a keyway, and the key is applicable to the keyway for engagement with the nut to secure the wear plate on the base.

The above provides the reader with a very brief summary of some embodiments discussed below. Simplifications and omissions are made, and the summary is not intended to limit or define in any way the scope of the invention or key aspects thereof. Rather, this brief summary merely introduces the reader to some aspects of the invention in preparation for the detailed description that follows.

BRIEF DESCRIPTION OF THE DRAWINGS

Referring to the drawings.

DETAILED DESCRIPTION

Figure 1A:
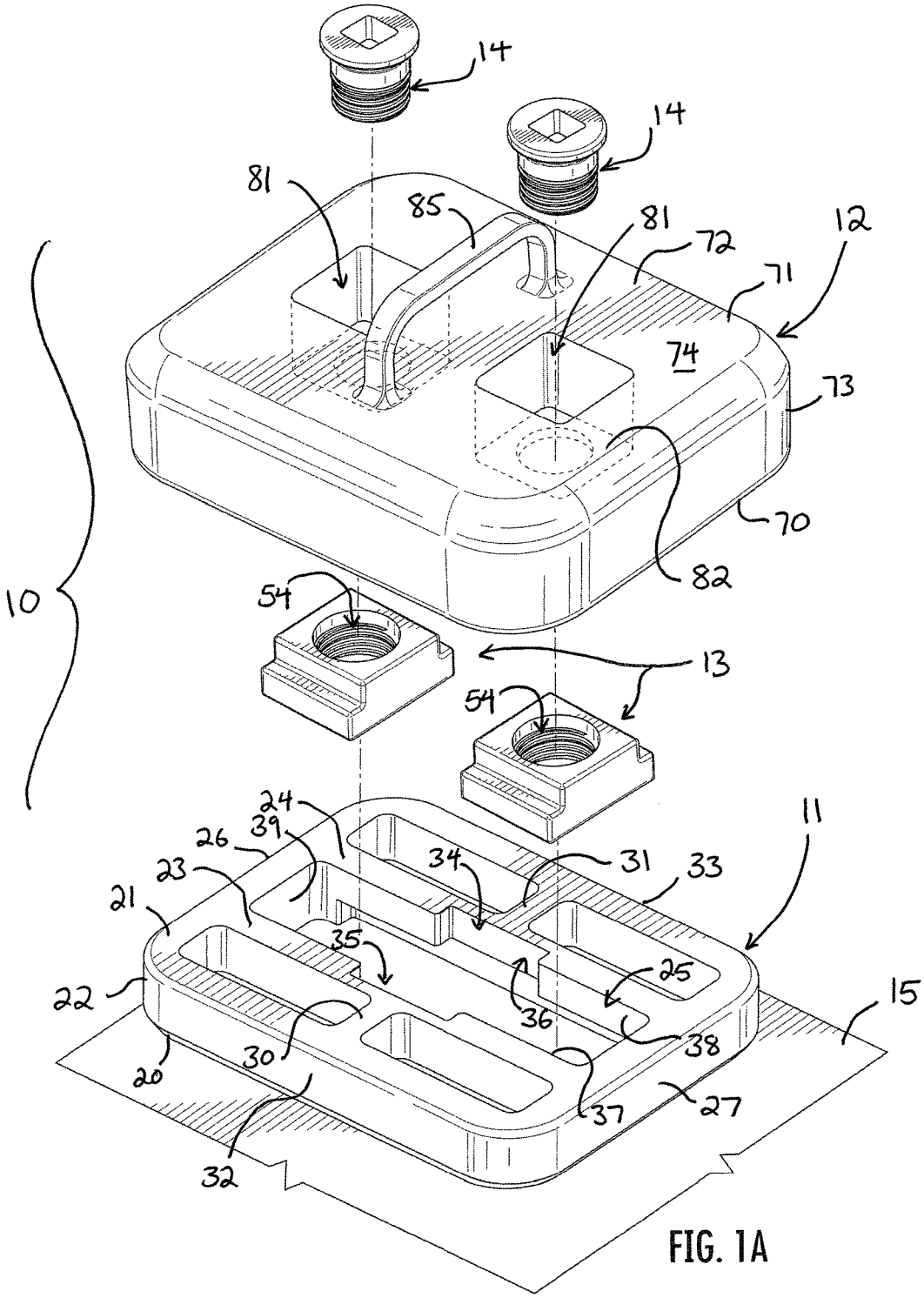
FIGS. 1A and 1B are exploded, top and bottom perspective views, respectively, of a wear plate assembly including a base, a wear plate, two nuts, and two keys.
Figure 1B:
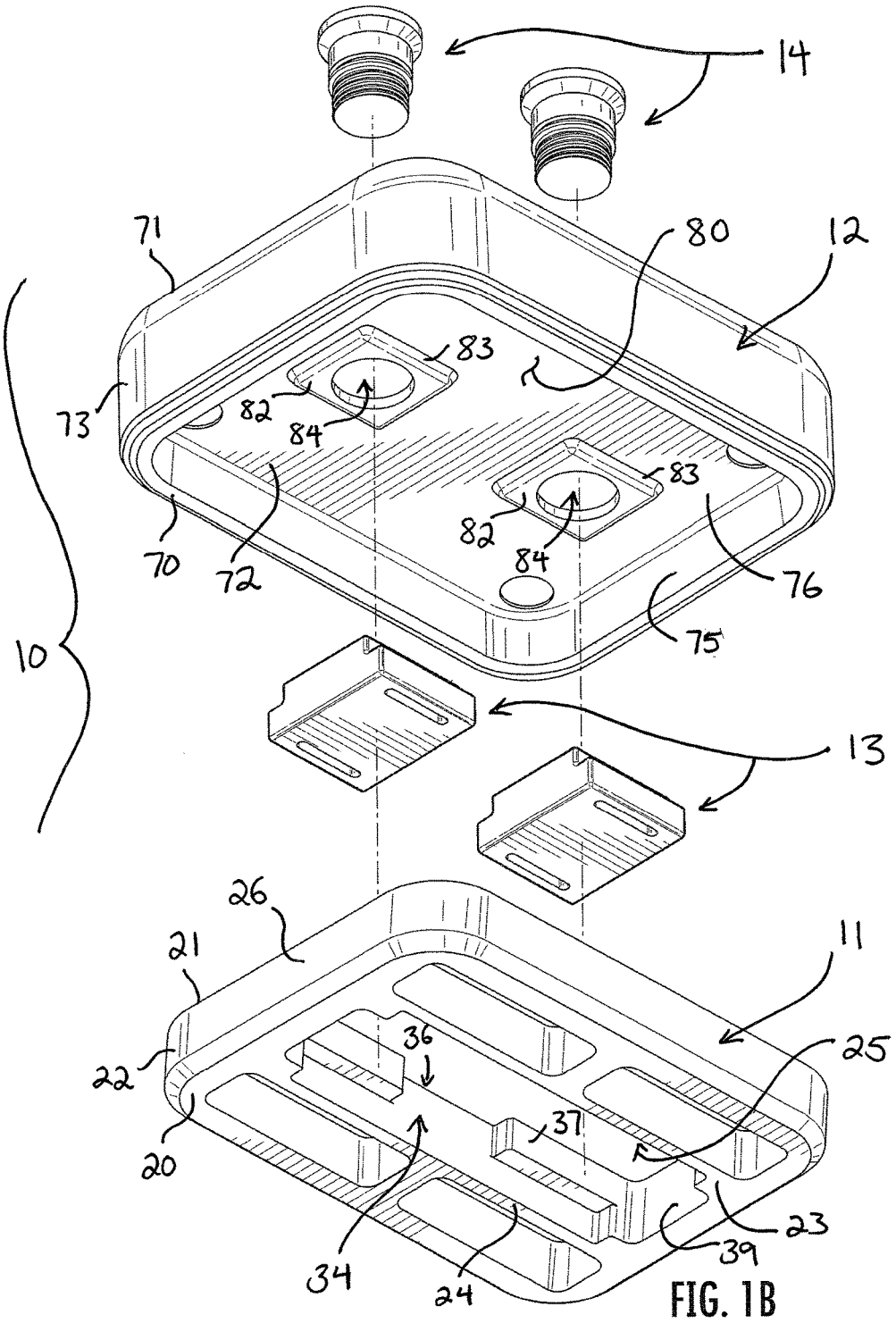

Reference now is made to the drawings, in which the same reference characters are used throughout the different figures to designate the same elements. FIGS. 1A and 1B illustrate a wear plate assembly 10 in exploded top and bottom perspective, respectively. The wear plate assembly 10 is suitable for use on heavy machinery, such as the excavator shown in FIG. 1 of U.S. Pat. No. 8,336,233, and can be used with any machinery for digging, ripping, crushing, cutting, lifting, or various other construction and demolition practices. The wear plate assembly 10 includes a base 11, a wear plate 12 for covering the base 11, nuts 13 applicable to the base 11, and keys 14 which can be passed through the wear plate 12 to engage with the nuts 13 when they are applied to the base 11, so as to secure the wear plate 12 on the base 11.

The base 11 is a bracket with a bottom 20, a top 21, and an upstanding sidewall 22 extending between the bottom 20 and the top 21. The base 11 also includes two ribs 23 and 24 extending laterally through the base 11 from one end 26 of the base 11 to another end 27. The ribs 23 and 24 are integrally and monolithically formed to the sidewall 22 as a single piece, and they extend parallel to each other to define a longitudinal slot 25 centrally located in the base 11. Short projections 30 and 31 extend from opposed sides 32 and 33 of the base 11 to the ribs 23 and 24, respectively. The projections 30 and 31 reinforce the ribs 23 and 24 and prevent deflection and deformation of the ribs 23 and 24.

An aperture 34 is located in the slot 25 generally intermediately between the opposed ends 26 and 27. The aperture 34 is a widened or enlarged section of the slot 25. While the slot 25 has a constant width between the ribs 23 and 24 for most of its length between the ends 26 and 27, the slot 25 is enlarged at the aperture 34.

The aperture 34 is defined by opposed rectangular notches 35 and 36 formed into the ribs 23 and 24, respectively. Proximate to the top 21 of the base 11, the ribs 23 and 24 have lips 37 and 38, respectively, which overhangs or project inwardly into the slot 25. The lips 37 and 38 both extend approximately halfway down from the top 21 toward the bottom 20. Because the lips 37 and 38 do not extend entirely to the bottom 20, the lips form a two-tiered inner surface 39 of the slot 25 on the ribs 23 and 24; an upper first tier projects further into the slot 25 than does a lower second tier. However, the aperture 34 is formed through the lips 37 and 38, so that they are eliminated in the enlarged section of the slot 25. As such, at the aperture 34, the inner surface 39 is flat and single-tiered.

As shown in FIG. 1A, the base 11 is fixed to a work surface 15 of a piece of heavy machinery. Preferably, the base 11 is welded to the work surface 15 continuously along the sidewall 22 at the bottom 20 of the base 11. After the base 11 is fixed to the work surface 15, in preparation for operation, the nuts 13 are applied to the base 11. Briefly, the nuts 13 are sized and shaped to be fit through the aperture 34 and then under the overhanging lips of the slot 25 to capture and retain the nuts 13 therein.

The nuts 13 are identical in every way, and only one will be described herein, with the understanding that the description applies equally to both nuts 13. One of the nuts 13 is shown in more detail in FIGS. 2A and 2B, which are exploded top perspective and side elevation views, respectively. The nut 13 has a solid body with a bottom 40, a top 41, and opposed ends 42 and 43. The ends 42 and 43 are flat and vertical, extending normally with respect to the bottom 40 and top 41, which are parallel to each other. The nut 13 also has opposed stepped sides 44 and 45.

Proximate the bottom 40 of the nut 13, the side 44 projects outwardly to a lower face 50, which extends further than does an upper face 51 proximate the top 41 of the nut 13. The lower and upper faces 50 and 51 are coextensive and parallel to each other, but are laterally offset from a center of the nut 13. Similarly, proximate the bottom 40 of the nut 13, the side 45 projects outwardly to a lower face 52, which extends further than does an upper face 53 proximate the top 41 of the nut 13. The lower and upper faces 52 and 53 are coextensive and parallel to each other, but are laterally offset from a center of the nut 13.

Formed into the nut 13 from opposite the bottom 40, and extending from the top 41 toward the bottom 40, is a blind bore 54. The bore 54 is cylindrical and formed with threads 55 to receive and threadably engage with the key 14. The threads 55 begin slightly below the top 41 of the nut 13 and wind helically around the bore 54 to the bottom 40.

Figure 2A:
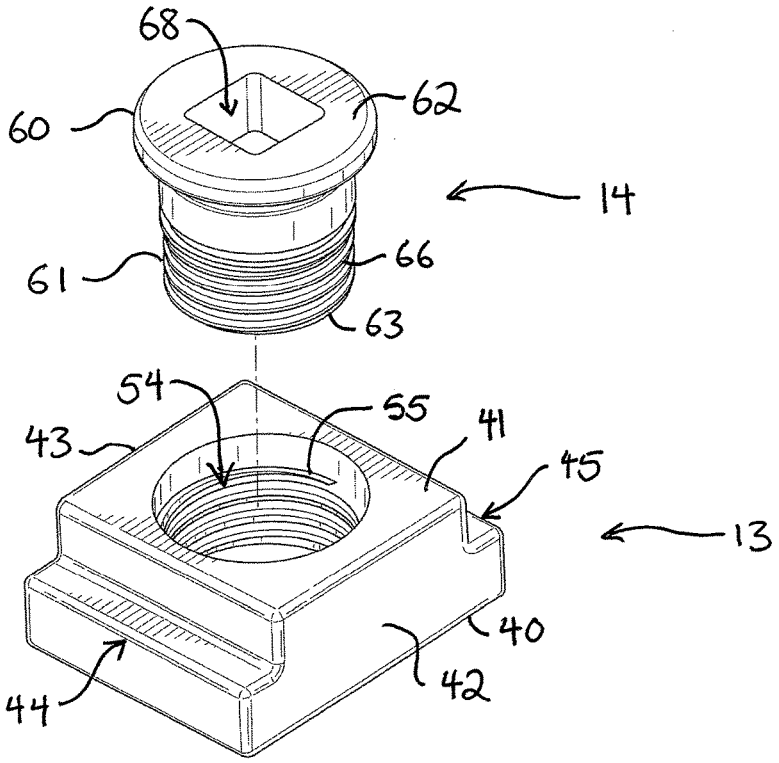
FIGS. 2A and 2B are top perspective and side elevation views, respectively, of the keys of FIG. 1A.
Figure 2B:
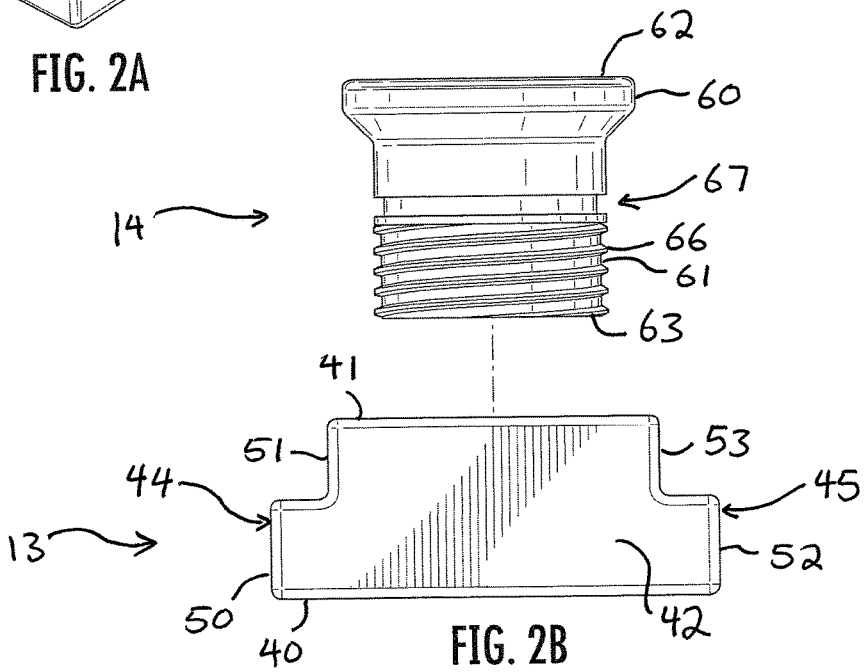

The key 14 shown in FIGS. 2A and 2B is a bolt-style, generally cylindrical key. It has an enlarged head 60 at its top 62 and a shank 61 extending from the top 62 to a bottom 63 of the head 60. The top 62 of the head 60 is flat and wide, and chamfers inwardly from the top 62 to a reduced diameter where the head 60 transitions integrally and monolithically to the shank 61. The shank 61 has an upper portion 64 and a lower portion 65. The upper portion 64, proximate the head 60, is smooth. The lower portion 65, proximate the bottom 63, is formed with threads 66 that are complemental to and threadably engage with the threads 55 in the nut 13. Between the upper and lower portions 64 and 65 is an annular channel 67 sized to receive an elastomeric gasket to limit the migration of dirt, dust, and other debris into the bore 54. The gasket is now shown in these drawings. The outer diameter of the shank 61 closely corresponds to the inner diameter of the bore 54 so that the key 14 fits tightly within the nut 13 when it is threadably engaged thereto. However, as is explained below, the head 60 does not seat against or lie flush against the top 41 of the nut 13; indeed, when the key 14 is engaged to the nut 13, the head 60 projects above the top 41 of the nut 13.

A square socket 68 is formed into the top 62 of the key 14. The socket 68 accepts a square-headed wrench so that the key 14 can be rotated in a first direction to engage the key 14 with the nut 13 and in a second direction to disengage the key 14 from the nut 13. The square socket 68 is less prone to accumulation and compacting of dirt, dust, and other debris.

Returning to FIGS. 1A and 1B, the wear plate 12 covers the base 11 to protect the base 11, and the work surface 15 below it, from wear. FIG. 1A show the wear plate 12 in a free condition off the base 11. The wear plate 12 is a solid body with a bottom 70, a top 71, a wear body 72 proximate the top 71, and a sidewall 73 depending from the wear body 72 to the bottom 70 around a perimeter of the wear plate 12.

The wear plate 12 is constructed from a wearable material or combination of materials having characteristics of ruggedness, durability, rigidity, and hardness, such as iron or steel, and is preferably integrally and monolithically formed or cast. The wear body 72 is disposed proximate to the top 71 and is very thick; the wear body 72 extends approximately halfway from the top 71 to the bottom 70. At the top 71, the wear body 72 has a wear surface 74 extending across the top 71 within the sidewall 73. As the heavy machinery operates, the wear body 72 is abraded, worn, and consumed, such that the wear surface 74 advances further toward the bottom 70 of the wear plate 12.

The sidewall 73 is an apron depending from the wear body 72. When the wear plate 12 is applied over the base 11, the sidewall 73 encircles and surrounds the sidewall 22 of the base 11 entirely, extending over it from the top 21 down to the bottom 20 of the base 11. The sidewall 73 has an inner surface 75, and the wear body 72 has an underside 76, which cooperate to define an interior cavity 80 of the wear plate 12. It is in the interior cavity 80 that the base 11 is received.

Two holds 81 are formed in the wear plate 12. The holds 81 are identical in every respect but for location, and as such, the description herein will refer only to a single hold 81. The hold 81 is a square recess extending into the wear body 72 from the top 71 of the wear plate 12 below the wear surface 74. The hold 81 has flat and straight sides extending from the top 71 to a seat 82 at a bottom 83 of the hold 81. The seat 82 is a flat endwall to the hold 81 and is disposed below the underside 76 of the wear body 72, as seen best in FIG. 1B. The seat 82 extends just beyond the underside 76 of the hold 81, and so the perimeter of the seat 82 is formed to the underside 76 so that the upper surface of the seat 82 is flat to accept the head 60 of the key 14. A round hole 84 is also formed through the hold 81. The inner diameter of the hole 84 is just larger than the outer diameter of the shank 61 of the key 14.

A handle 85 is formed to the wear surface 74 at the top 71 of the wear plate 12. The handle 85 allows workers to carry the heavy wear plate 12 and set it on the base 11 when installing the wear plate assembly 10. The handle 85 is one of the first parts of the wear plate assembly 10 to wear down during operation of the heavy machinery.

In operation, the wear plate assembly 10 is secured on the work surface 15 to protect it from wear and damage. Initially, the work surface 15 is prepared by cleaning. Dust and dirt are removed and the work surface 15 is washed or made clean. The base 11 is then fixed to the work surface 15 such as by welding. Preferably, a continuous weld is formed along the sidewall 22 at the bottom 20 of the base 11, thereby binding the base 11 to the work surface 15. Formation of a continuous weld prevents the ingress of dirt, dust, and debris into the interior of the base 11 when the wear plate assembly 10 is in use.

Figure 3A:
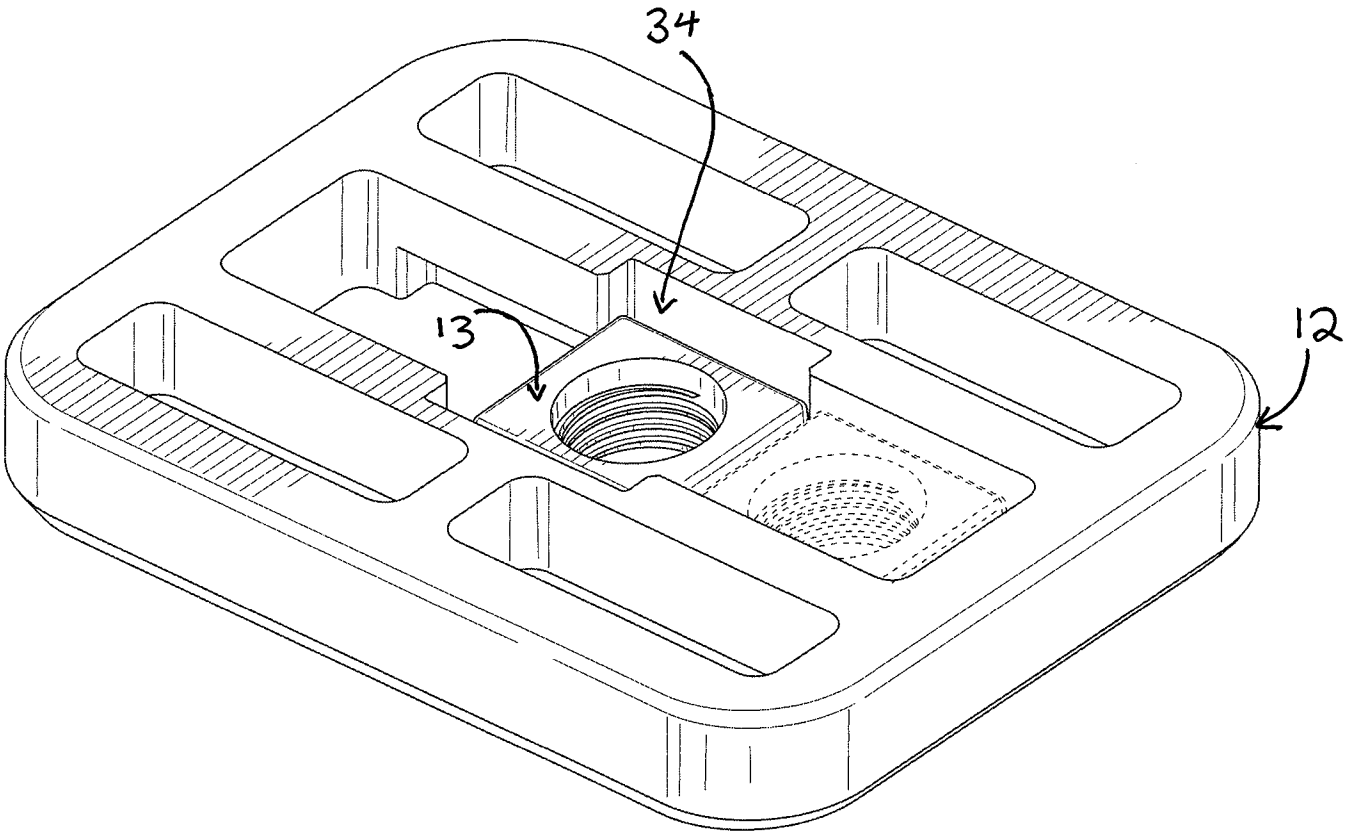
FIGS. 3A-3D show a sequence step of assembling the wear plate assembly of FIG. 1A.

Once the base 11 is so secured, the nuts 13 are applied thereto. The first nut 13 is taken up, such as by hand, and the bottom 40 of the nut 13 is directed downward toward the base 11. The rectangular nut 13 is registered with the rectangular aperture 34 and then applied through the aperture 34, still with the bottom 40 of the nut directed toward the base 11. The nut 13 is fully applied through the aperture 34, so that the nut 13 is in a first position in which the nut 13 is disposed and registered in the aperture 34 and the bottom 40 of the nut 13 is against the work surface 15, as seen in FIG. 3A. In this first position of the nut 13, the sides 44 and 45 of the nut 13 are in snug contact with the ribs 23 and 24, respectively. The lower faces 50 and 52 are each in sliding contact with the inner surface 39 of the slot 25, but, because the nut 13 is disposed in the aperture 34 where the notches 35 and 36 prevent the lips 37 and 38 from overhanging, the upper faces 51 and 53 are not in contact with the inner surface 39 of the slot 25. The opposed sides 44 and 45 at the widened bottom 40 of the nut 13 contact the inner surface 29 of the slot 25 snugly and prevent rotation of the nut 13 with respect to the base 11. Further, because the nut 13 is snugly received in the slot 25, lateral play of the nut 13 between the ribs 23 and 24 is minimized. As such, the only direction in which the nut 13 can move other than out through the aperture 34, is in a translational or lateral direction between the opposed ends 26 and 27 of the base 11.

Indeed, the nut 13 is translated through the slot 25 to a second position also shown in FIG. 3A. The lower faces 50 and 52 are each in sliding contact with the inner surface 39 of the slot 25, and once the nut 13 moves just away from the aperture 34, the upper faces 51 and 53 are in sliding contact with the inner surface 39 along the overhanging lips 37 and 38. Indeed, as soon as the nut 13 is offset from the aperture 34, the widened bottom 40 of the nut 13 is in abutting contact with each of the overhanging lips 37 and 38; the interaction between the bottom 40 and the overhanging lips 37 and 38 prevents the nut 13 from lifting vertically out of the slot 25. And so the nut 13 can only be translated between the first and second positions. In the second position of the nut 13, the nut 13 has been translated fully toward the end 27 of the base 11 (though it could readily be translated toward the other end 26 as well).

In the second position of the nut 13, the nut 13 is offset from the aperture 34 and is captured by the base 11. The end 42 of the nut 13 is in abutting contact with the inner surface 39 of the slot 25 proximate the end 27 of the base 11. The lower faces 50 and 52 remain in sliding contact with the inner surface 39 of the slot 25, and the upper faces 51 and 53 remain in sliding contact with the inner surface 39 along the overhanging lips 37 and 38. The widened bottom 40 of the nut 13 remains in abutting contact with each of the overhanging lips 37 and 38, thereby preventing the nut 13 from lifting vertically out of the slot 25.

With the first nut 13 moved to the second position, the aperture 34 is open. The second nut 13 can thus be picked up, passed through the aperture 34 like the first nut 13, and the translated to its own second position, opposite the first nut 13. In other words, the second nut 13 is translated in the opposite direction, toward the other end 26, in the same fashion that the first nut 13 is moved toward the end 27. In this way, the nuts 13 are placed in abutting contact with the inner surface 39 at opposite ends of the slot 25.

With the nuts 13 so captured, the wear plate 12 can then be applied over the base 11. The wear plate 12, with its solid wear body 72, is quite heavy and is preferably picked up by the handle 85. The wear plate 12 is moved above the base 11, with its bottom 70 directed downward toward the base 11. The wear plate is registered with the base 11 so that the holds 81 are registered with the nuts 13 in their second positions, as shown in the free condition of the wear plate 12 in FIGS. 1A and 1B. The wear plate 12 is then moved to an applied condition as in FIG. 3B; it is lowered over the base 11 until the underside 76 rests in direct and flush contact with the top 21 of the base 11 so that the wear plate 12 covers the base 11. When the wear plate 12 is seated, the bottom 70 of the wear plate 12 is above the work surface 15 with a small gap therebetween. Further, the sidewall 73 of the wear plate 12 encircles and closely receives the sidewall 22 of the base 11, so that the wear plate 12 is prevented from moving laterally on the base 11.

Figure 3B:
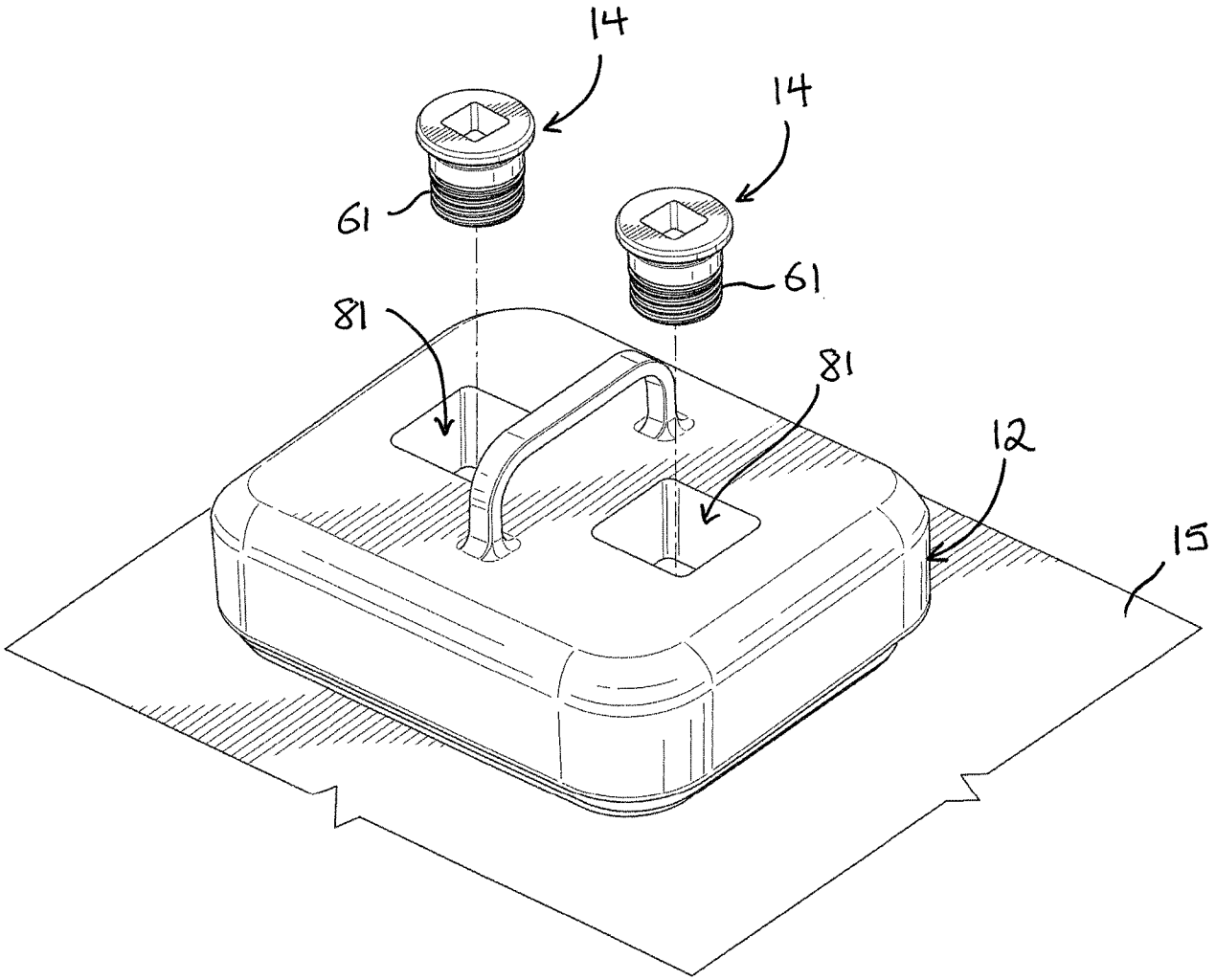
Figure 3C:
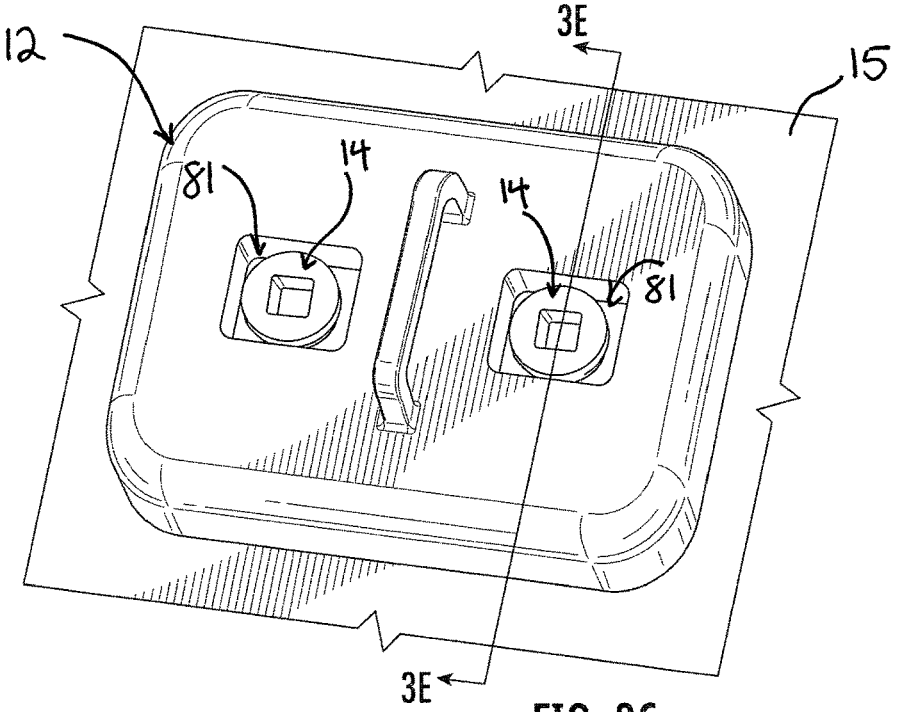
Figure 3D:
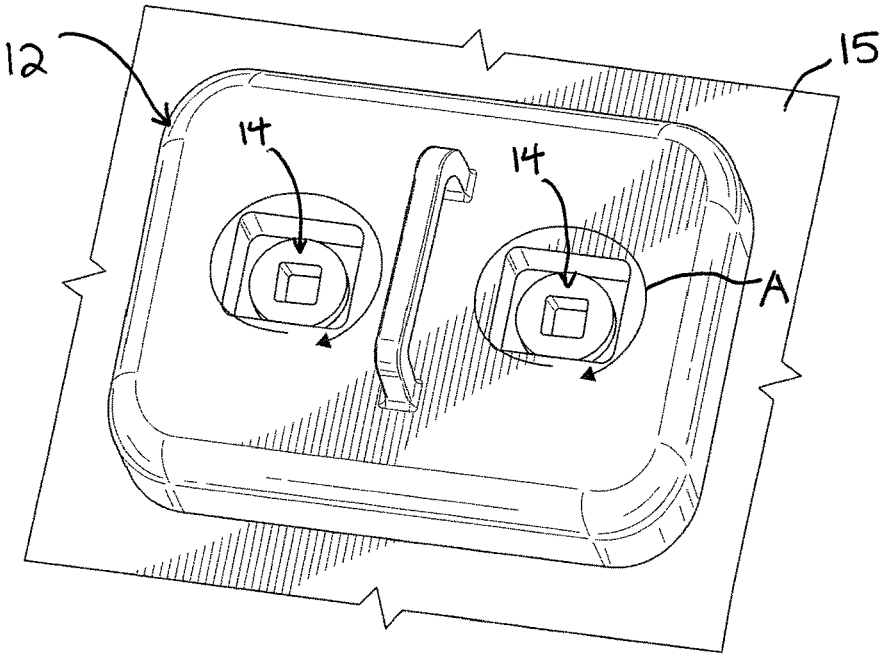

Once the wear plate 12 has been applied over the base 11 with the nuts 13 captured therein, the keys 14 can be applied. When the nuts 13 are in the second positions, the nuts 13 are below the underside 76 of the wear plate 12, and the bores 54 of the nuts 13 are registered with the slot 25 and with the holds 81 of the wear plate 12. The holds 81 are directly above the bores 54. In this applied condition of the wear plate 12 and the second position of the nut 13, the bore 54, the slot 25, and the hold 81 define a keyway 86 to receive the key 14, as shown best in FIG. 3E. The keys 14 are applicable to the keyways 86. As seen in FIG. 3B, the keys 14 are held above the holds 81, with the shanks 61 directed downward toward the holds 81. Each key 14 is moved downward and passed into a respective one of the holds 81, as shown in FIG. 3C. FIG. 3C is a top perspective view illustrating the keys 14 applied to the holds 81. Referring to just one of keys 14, because the description applies equally to both, the key 14 is in a non-engaged condition. In the non-engaged condition of the key 14, the key 14 is applied to the hold 81 but the threads 66 of the key 14 are not yet threadably engaged with the threads 55 of the nut 13; the bottom 63 of the key 14 is still above the threads 55. To threadably engage the key 14 with the nut 13, the key 14 is rotated in the first direction with respect to the nut 13, indicated by the arrowed line A in FIG. 3D. The key 14 is rotated with respect to the nut 13 until it is fully seated.

Figure 3E:
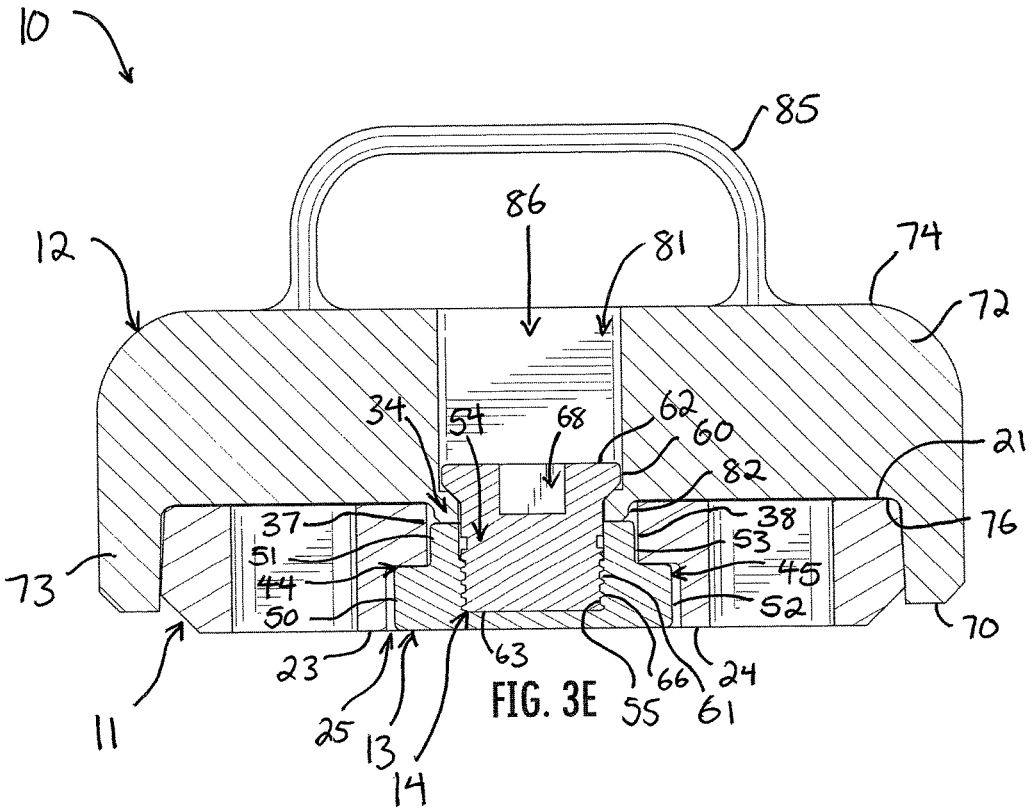
FIG. 3E is a section view taken along the line 3E-3E in FIG. 3C.

FIG. 3E is a section view take along the line 3E-3E in FIG. 3C and shows the key 14 fully seated in the nut 13. The head 60 of the key 14 is in direct and continuous contact with the seat 82 of the hold 81. The head 60 is closely received laterally between the sides of the hold 81. The shank 61 extends through the bore 54, and the bottom 63 of the key 14 is in direct and continuous contact against the bottom 40 of the nut 13. When the key 14 is fully threadably engaged in this manner, the nut 13 and the key 14 are prevented from separating from each other and also from translating with respect to the base 11 or the wear plate 12. With the nut 13 and key 14 secured to each other, and with the head 60 of the key 14 bearing against the seat 82 of the wear plate 12 and the widened bottom 40 of the nut 13 bearing against the lips 37 and 38 of the base 11, the wear plate 12 is secured on the base 11. And, of course, since the base 11 is fixed to the work surface 15, the wear plate 12 is secured to the work surface 15 to cover and protect it.

With the wear plate assembly 10 so protecting the work surface 15, the heavy machinery can be operated without risk of damage to the work surface 15 under the wear plate assembly 10. As the heavy machinery operates, the handle 85 is broken off or worn down, and the wear body 72 gradually becomes worn down as well, lowering the wear surface 74 toward the work surface 15. Eventually, the wear body 72 is worn away so that the wear surface 74 is close to the top 62 of the key 14. Routine inspection will find that the wear plate assembly 10 has been worn sufficiently to justify maintenance.

Full replacement of the wear plate assembly 10 is not necessary. Rather, when the wear plate assembly 10 requires maintenance, a worker takes a square-headed wrench and inserts it into the socket 68 of the key 14. The worker then rotates the wrench and the key 14 in the second direction, opposite the first direction of the arrowed line A. Rotation in the second direction threadably disengages the key 14 from the nut 13, backing the key 14 out of the nut 13 in an upward direction. When the threads 66 of the key 14 fully disengage from the nut 13, the key 14 can be removed and discarded, as can the wear plate 12. The base 11 is left still secured to the work surface 15, and the nuts 13 are still in the slot 25. If the nuts 13 need to be replaced, they can be removed by translating them from their second positions to the first position in the aperture 34 and then withdrawing them from the base 11 through the aperture 34. New nuts 13 can be introduced to the base 11 as described above, a new wear plate 12 can be applied over the base 11 as described above, and new keys 14 can then be applied and engaged, as described above. In this way, the wear plate assembly 10 can be continually repaired and re-used.

FIGS. 4A-4E illustrate an alternate embodiment of a nut 90 and key 91 suitable for use with the base 11 and wear plate 12. The nut 90 and key 91 are of the same size as the nut 13 and key 14 but a different engagement system.

The nut 90 has a solid body with a bottom 92, a top 93, and opposed ends 94 and 95. The ends 94 and 95 are flat and vertical, extending normally with respect to the bottom 92 and top 93, which are parallel to each other. The nut 90 also has opposed stepped sides 96 and 97. Proximate the bottom 92 of the nut 90, the side 96 projects outwardly to a lower face 100, which extends further than does an upper face 101 proximate the top 93 of the nut 90. The lower and upper faces 100 and 101 are coextensive and parallel to each other, but are laterally offset from a center of the nut 90. Similarly, proximate the bottom 92 of the nut 90, the side 97 projects outwardly to a lower face 102, which extends further than does an upper face 103 proximate the top 93 of the nut 90. The lower and upper faces 102 and 103 are coextensive and parallel to each other, but are laterally offset from a center of the nut 90.

Formed into the nut 90, from the top 93 to the bottom 92, is a cylindrical blind bore 104. Two shelves 105 and 106 extend into the bore 104 from opposed sides of the bore 104. The shelves 105 and 106 are lateral projections, each having a flat top 107, a flat bottom 108, and a blunt end 109. The bore 104 receives the key 91 and the shelves 105 and 106 engage the key 91 to secure it in the nut 90.

Figure 4A:
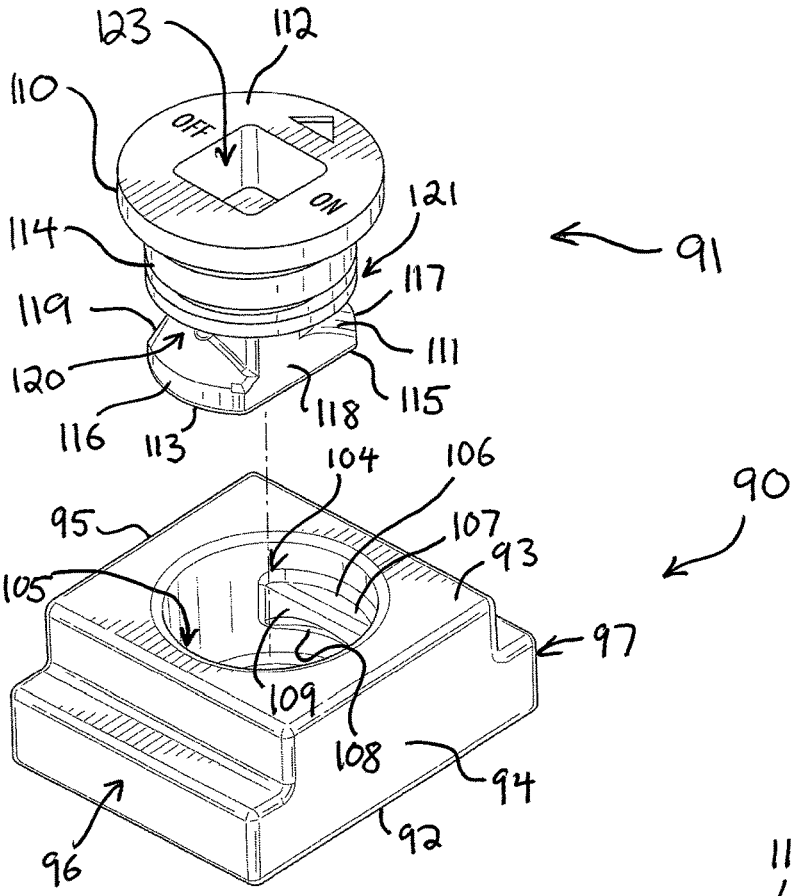
FIGS. 4A and 4B are top perspective and side elevation views, respectively, of an alternate embodiment of a key.
Figure 4B:
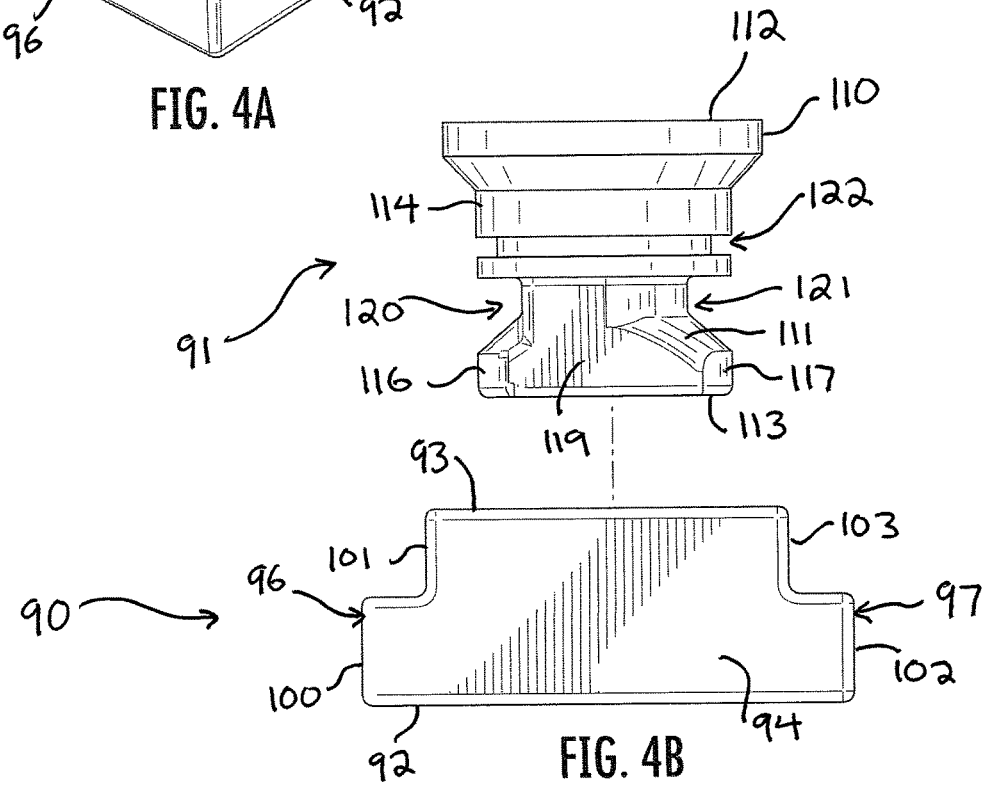

The key 91 shown in FIGS. 4A and 4B is a bolt-style, generally cylindrical key. It has an enlarged head 110 at its top 112 and a shank 111 extending from the top 112 to a bottom 113 of the head 110. The top 112 of the head 110 is flat and wide, and chamfers inwardly from the top 112 to a reduced diameter where the head 110 transitions integrally and monolithically to the shank 111. The shank 111 has an upper portion 114 and a lower portion 115. The upper portion 114, proximate the head 110, is smooth. The lower portion 115, proximate the bottom 113, is formed with two opposed lobes 116 and 117 and two opposed flat sides 118 and 119 extending between the opposed lobes 116 and 117. The lobes 116 and 117 are projections extending laterally from the lower portion 115 of the shank 111. Above the lobes 116 and 117 are flat recesses 120 and 121.

Between the upper and lower portions 114 and 115 is an annular channel 122 sized to receive an elastomeric gasket to limit the migration of dirt, dust, and other debris into the bore 104. The outer diameter of the upper portion 115 of the shank 111 closely corresponds to the inner diameter of the bore 104 so that the key 91 fits tightly within the nut 90 when it is threadably engaged thereto. However, the head 110 does not seat against or lie flush against the top 93 of the nut 90; indeed, when the key 91 is engaged to the nut 90, the head 110 projects above the top 93 of the nut 90.

A square socket 123 is formed into the top 112 of the key 91. The socket 123 accepts a square-headed wrench so that the key 91 can be rotated in a first direction to engage the key 91 with the nut 90 and in a second direction to disengage the key from the nut 90. The square socket 123 is less prone to accumulation and compacting of dirt, dust, and other debris.

Figure 4C:
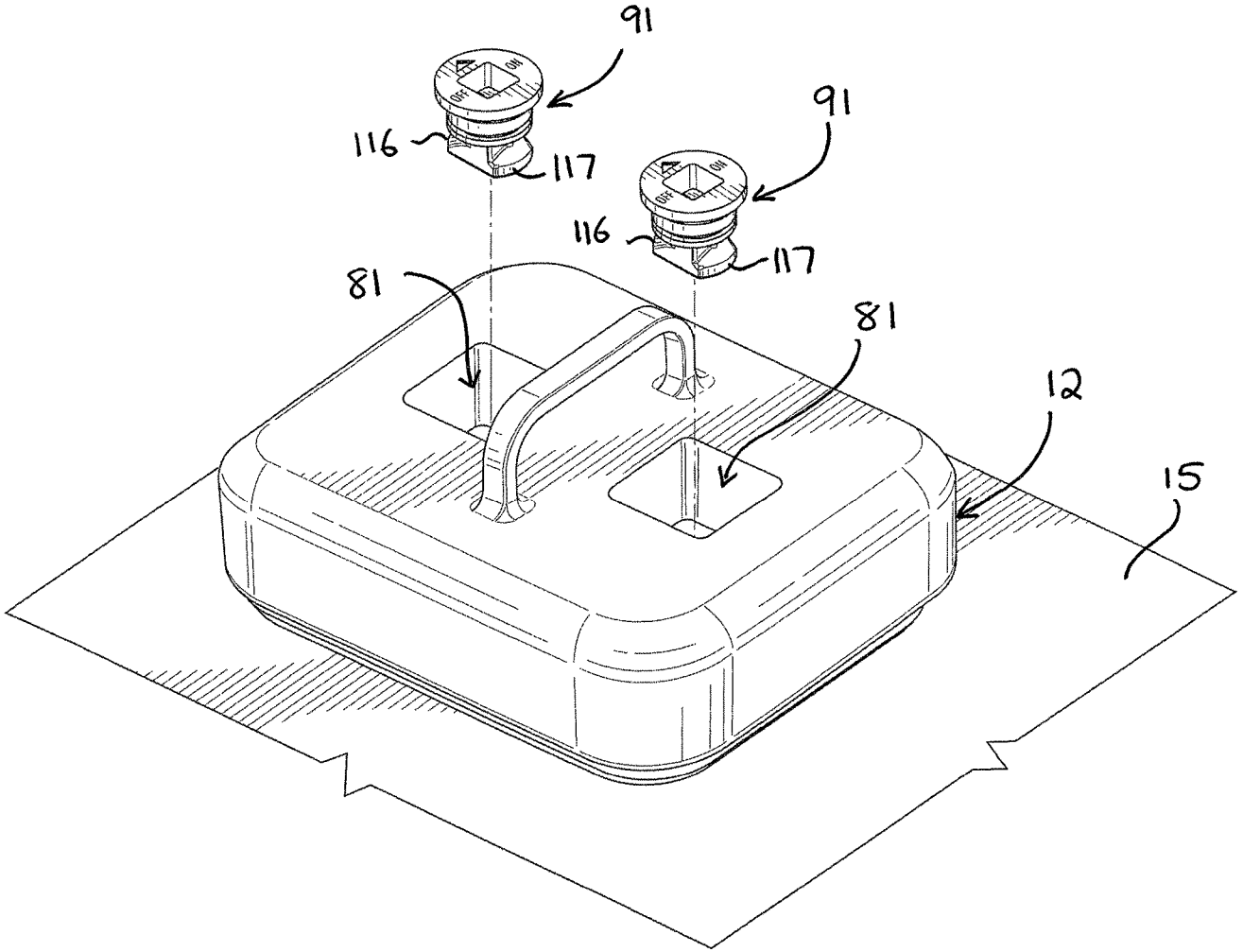
FIGS. 4C-4E show a sequence step of assembling the wear plate assembly with the keys of FIG. 4A.
Figure 4D:
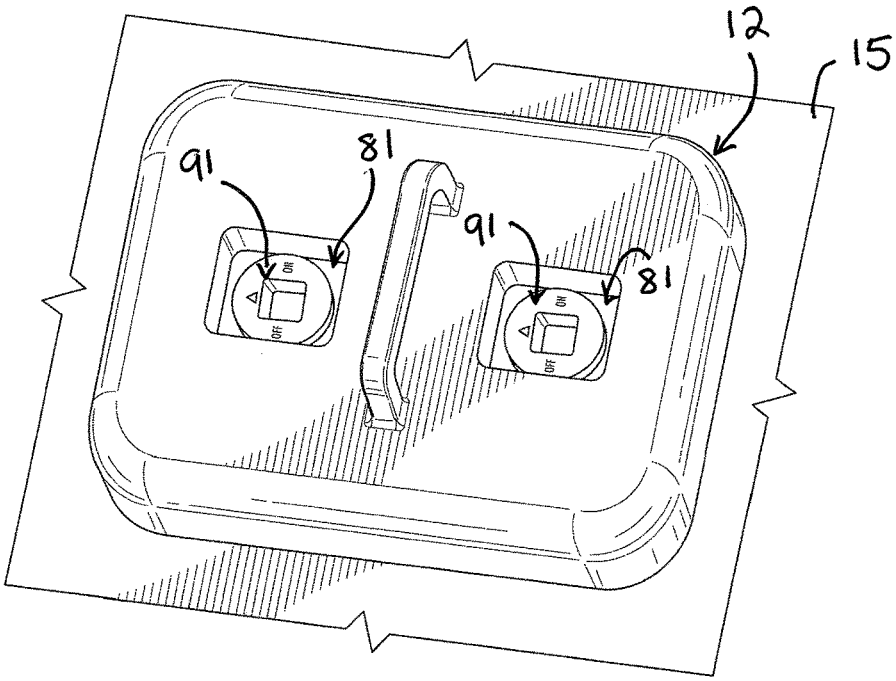
Figure 4E:
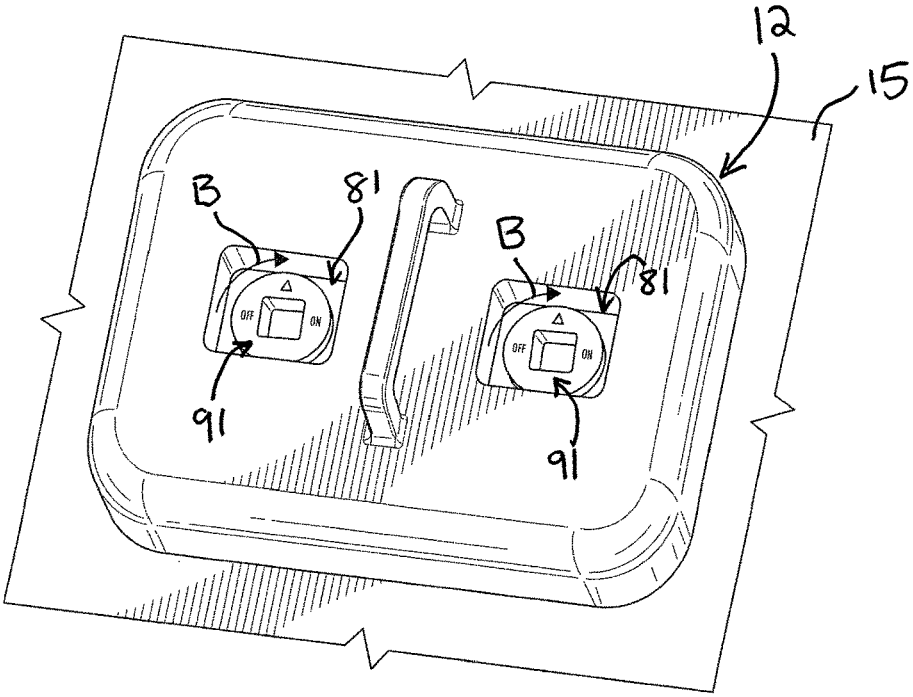

In operation, the nut 90 and key 91 are used with the base 11 and the wear plate 12. The base 11 is secured to the work surface 15 as described above. The nuts 90 are also applied to the slot 25 of the base 11 in the same fashion as described with respect to the nuts 13. Then, the wear plate 12 is applied over the base 11 as described above. Finally, the keys 91 are registered with the holds 81 of the wear plate 12, as shown in FIG. 4C. The keys 91 are oriented so that the lobes 116 and 117 are aligned with the slot 25, directed toward the ends 26 and 27 of the base 11. Each key 91 is then moved downward through the hold 81 of the wear plate 12. When applied to the hold 81 in this orientation, the flat sides 118 and 119 fit between the blunt ends 109 of the opposed shelves 105 and 106 and the key 91 may be moved fully downward, seating the key 91 in the bore 104 of the nut 90. This places the key 91 in an applied, but non-engaged, condition, as shown in FIG. 4D. To engage the key 91, the worker inserts the square wrench in the socket 123 and quarter-turns the key 91 in a first direction as indicated by the arrowed line B in FIG. 4E. When the key 91 is quarter-turned, the lobes 116 and 117 rotate under the shelves 105 and 106. The recesses 120 and 121 fit between the opposed shelves 105 and 106, but the opposed lobes 116 and 117 extend beyond them. The recesses 120 and 121 of the key 91 come into opposition with the blunt ends 109 of the shelves 105 and 106, and the bottom of the upper portion 114 of the shank 111 is in contact above the shelves 105 and 106. In other words, the shelves 105 and 106 are disposed between the upper portion 114 and the opposed lobes 116 and 117.

When the key 91 is fully engaged in this manner, the nut 90 and the key 91 are prevented from separating from each other and also from translating with respect to the base 11 or the wear plate 12. With the nut 90 and key 91 secured to each other, and with the head 110 of the key 91 bearing against the seat 82 of the wear plate 12 (as with the nut 13 and key 14) and the widened bottom 92 of the nut 90 bearing against the lips 37 and 38 of the base 11, the wear plate 12 is secured on the base 11. And, of course, since the base 11 is fixed to the work surface 15, the wear plate 12 is secured to the work surface 15 to cover and protect it. To loosen the key 91 and separate it from the nut 90, the key 91 merely needs to be rotated a quarter turn in a second direction opposite the first.

Figure 5A:
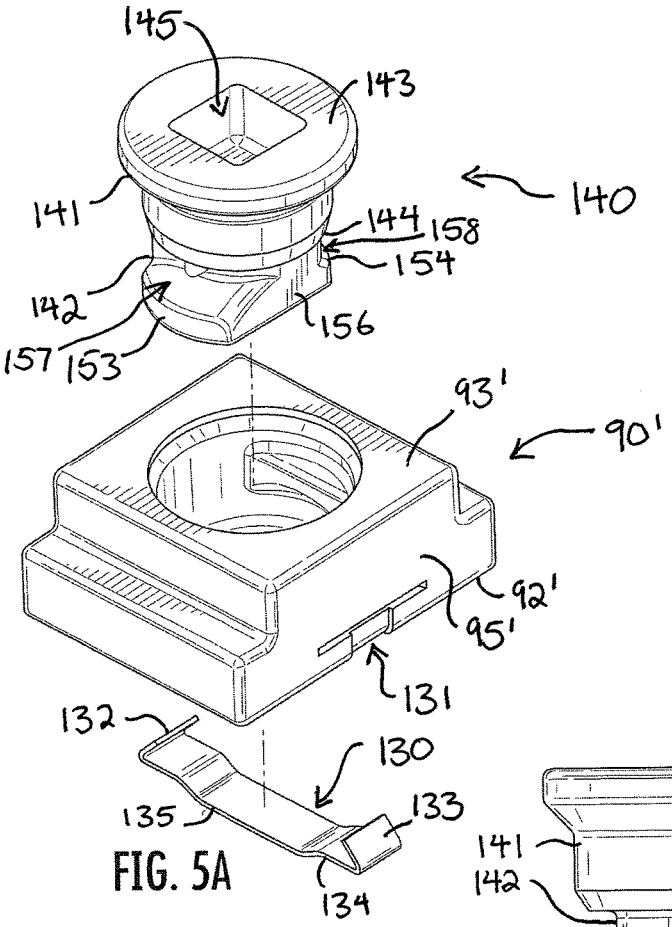
FIGS. 5A, 5B, and 5C are top perspective, side elevation, and exploded top perspective views, respectively, of an alternate embodiment of a key.
Figure 5B:
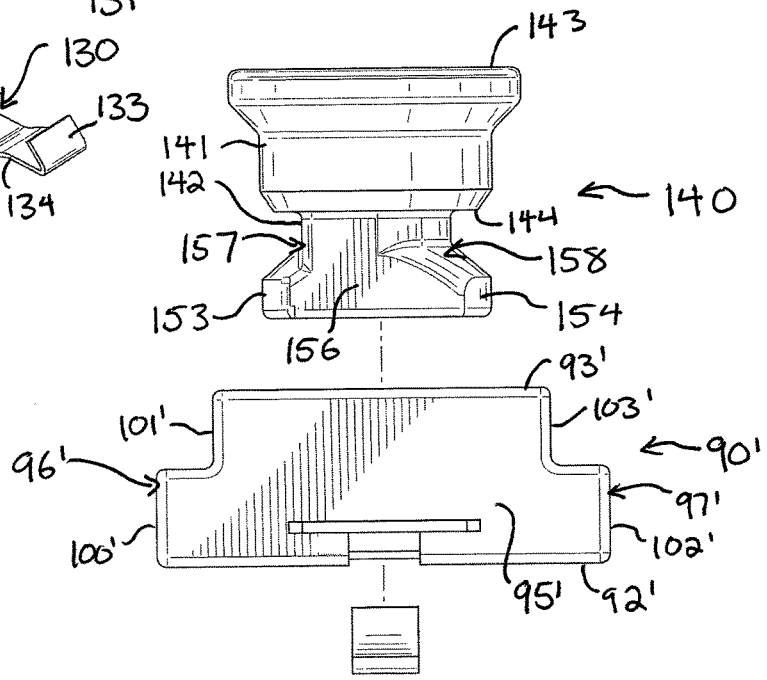
Figure 5C:
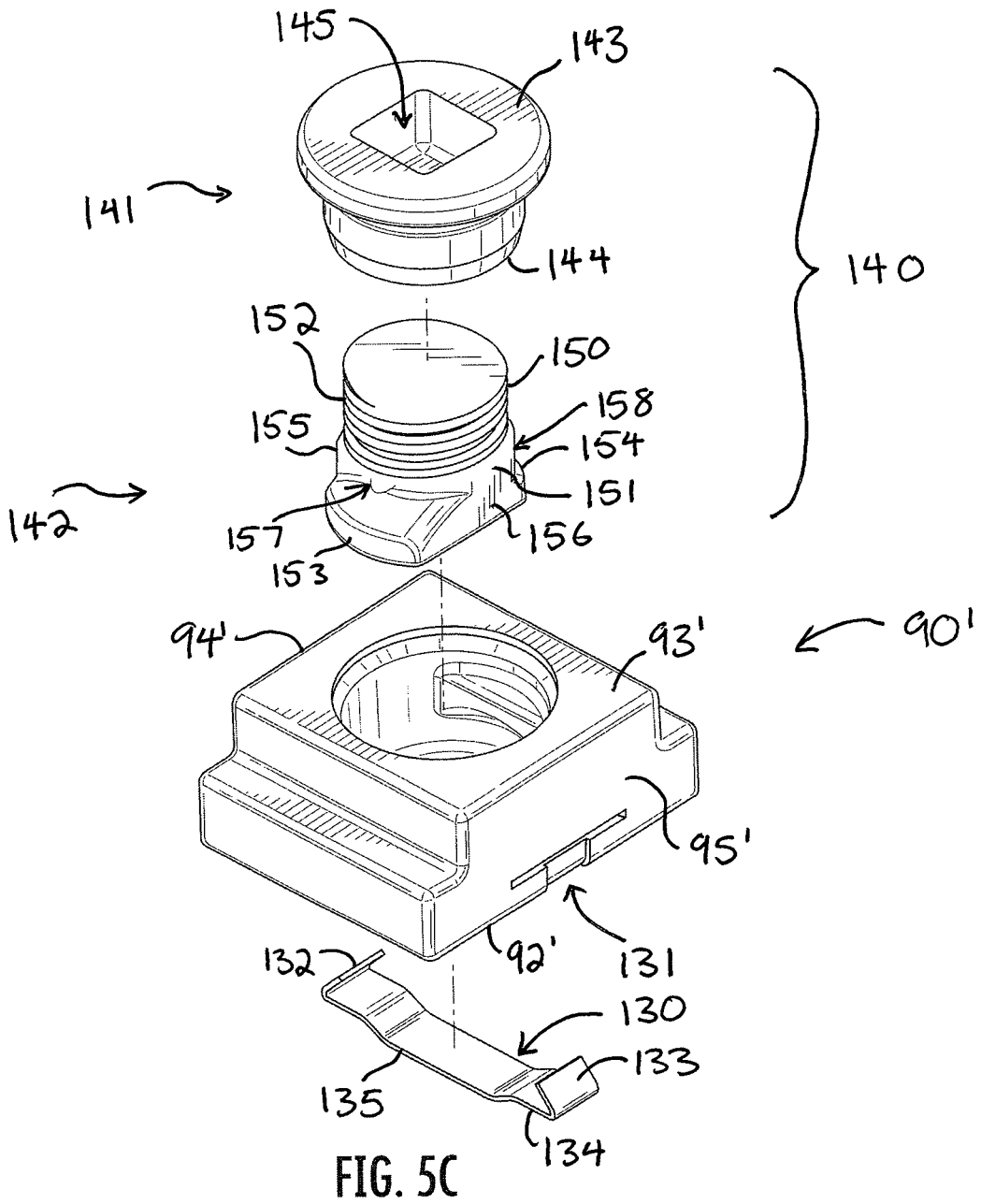

FIGS. 5A-5C show another embodiment of the nut 90 and key 91. This embodiment is nearly identical to that shown in FIGS. 4A-4E but for a few changes. The nut 90' is essentially identical to the nut 90 but for the inclusion of a channel and clip. And the key 140 is essentially identical to the key 91 except that the key 140 is a two-piece assembly. Each is addressed below.

First, the nut is essentially identical to the nut 90, and so the same names and reference characters are used but are marked with a prime ("") symbol to distinguish them from those of the nut 90. A clip 130 is applied to the bottom 92' of the nut 90'. A short channel 131 is formed along the bottom 92' and slightly up into the ends 94' and 95'. The channel 131 receives the clip 130. The clip 130 is roughly C-shaped; it has opposed short ends 132 and 133 which project upwardly, and a wide back 134 which is slightly curved in a convex fashion. In the middle of the back 134 is a spine 135 which is bent away from the ends 132 and 133. The curve of the back 134 and the spine 135 create a spring force in the clip 130.

When the clip 130 is placed into the channel 131, with the ends 132 and 133 fit over the channel 131 on the ends 94' and 95', the spine 135 projects slightly away from the bottom 92' of the nut 90'. When the nut 90' is then placed into the slot 25 in the base 11, the clip 130 is compressed between the bottom 92' of the nut 90' and the working surface 15 under the base 11. The slip 130 biases the nut 90' upward, which increases the hold of the engagement between the nut 90' and key 91' and between the base 11 and the wear plate 12.

The key 140 is similar to the key 91, but is formed from two separate pieces: a head 141 and a shank 142. The head 141 has a top 143 and an opposed bottom 144. The top 143 of the head 141 is flat and wide, and chamfers inwardly from the top 143 to a reduced diameter at the bottom 144. A cylindrical, threaded bore is formed upward into the head 141 from the bottom 144. That bore is sized and shaped to receive the shank 142. A square socket 145 is formed into the top 143 of the head 141. The socket 145 accepts a square-headed wrench so that the key 140 can be rotated in a first direction to engage the key 140 with the nut 90' and in a second direction to disengage the key 140 from the nut 90'.

The shank 142 has an upper portion 150 and a lower portion 151. The upper portion 150 is formed with threads 152, which threads 152 correspond to threaded bore of the head 141. The lower portion 151 is formed with two opposed lobes 153 and 154 and two opposed flat sides 155 and 156 extending between the opposed lobes 153 and 154. The lobes 153 and 154 are projections extending laterally from the power portion 151 of the shank 142. Above the lobes 153 and 154 are flat recesses 157 and 158.

In use, the nut 90] is placed into the slot and the clip 130 is compressed, as described above. When the wear plate 12 is placed over the base 11, the keyway is ready to accept the key 140. If the key 140 has not previously been assembled, the worker must assemble the key 140. To do this, the worker simply grasps the shank 142 at the lower portion 151 and registers the threaded upper portion 150 with the threaded bore in the bottom 144 of the head 141. The worker then threadably engages the shank 142 into the head 141 a desired distance. The key 140 can now be applied to the keyway. The worker inserts the key 140 into the hold 81 and into the non-engaged condition. To engage the key 140, the worker inserts the square wrench in the socket 145 and quarter-turns the key 140 in a first direction. This causes the lobes 153 and 154 to rotate under the shelves 105 and 10. The recesses 157 and 158 fit between the opposed shelves 105 and 106, but the opposed lobes 153 and 154 extend beyond them. The recesses 157 and 158 of the key 140 come into opposition with the blunt ends 109 of the shelves 105 and 106, and the bottom of the upper portion 150 of the shank 142 is in the contact above the shelves 105 and 106. In other words, the shelves 105 and 106 are disposed between the upper portion 150 and the opposed lobes 116 and 117.

When the key 140 is fully engaged in this manner, the nut 90' and the key 140 are prevented from separating from each other and also from translating with respect to the base 11 or the wear plate 12. With the nut 90' and key 140 secured to each other, and with the head 141 of the key 140 bearing against the lips 37 and 38 of the base 11, the wear plate 12 is secured on the base 11. The worker can, if desired, increase the holding power between the base and the wear plate 12 by re-inserting the square wrench into the socket 145 and then rotating the head 141 with respect to the shank 142 in the first direction. This will cause the head 141 to rotate down on the threads 152 of the shank 142. Alternatively, the worker can decrease the holding power by rotating the square wrench in the second direction.

A preferred embodiment is fully and clearly described above so as to enable one having skill in the art to understand, make, and use the same. Those skilled in the art will recognize that modifications may be made to the description above without departing from the spirit of the invention, and that some embodiments include only those elements and features described, or a subset thereof. To the extent that modifications do not depart from the spirit of the invention, they are intended to be included within the scope thereof.

The invention claimed is:

1. A wear plate assembly comprising:

a base including a slot formed with an enlarged aperture;

a wear plate including a wear surface and a hold recessed below the wear surface, wherein the wear plate moves between a free condition off the base and an applied condition covering the base;

a nut and a key, the nut formed with a blind bore to receive the key;

the key includes an annular channel for carrying a gasket to prevent migration of debris into the bore; and the nut is applicable through the aperture into the slot, and then moves between a first position registered in the aperture and a second position offset from the aperture where the nut is captured under the base;

wherein in the applied condition of the wear plate and the second position of the nut, the bore is registered with the slot and the hold to define a keyway, and the key is applicable to the keyway for engagement with the nut to secure the wear plate on the base.

2. The wear plate of claim 1, wherein:

the nut is formed with threads; and the key is formed with threads complemental to the threads on the nut.

3. The wear plate of claim 1, wherein:

the nut is formed with two opposed shelves extending into the bore; and the key is formed with a shank having two opposed lobes, two opposed flat sides extending between the opposed lobes, and two opposed recesses above the lobes;

wherein the opposed flat sides of the key fit between the opposed shelves of the nut, the recesses fit between the opposed shelves of the nut, and the opposed lobes extend beyond the opposed shelves of the nut.

4. The wear plate of claim 1, wherein the slot has an overhanging lip which captures the nut when the nut is in the second position thereof.

5. The wear plate of claim 4, wherein the nut has a widened bottom which is in abutting contact with the overhanging lip when the nut is in the second position thereof.

6. The wear plate of claim 1, wherein the nut has a widened bottom with opposed sides that contact the slot to prevent rotation of the nut with respect to the base.

7. The wear plate of claim 1, wherein the key is rotated in a first direction to engage with the nut and is rotated in a second direction opposite the first direction to disengage with the nut.

8. The wear plate of claim 1, wherein, when the key is applied to the nut, the wear plate is in the applied condition, and the nut is in the second position, the key and the nut are prevented from separating from each other and from translating with respect to the base.

9. The wear plate of claim 1, wherein:

the wear plate has a wear body extending between the wear surface and an underside of the wear body, the wear body constructed from a wearable material; and the nut is disposed below the underside of the wear body when the wear plate is in the applied condition and the nut is in the second position.

10. The wear plate of claim 9, further comprising a seat at the bottom of the hold, the seat disposed below the underside of the wear body.

11. A wear plate assembly comprising:

a base including a bottom, a top, a sidewall, and ribs extending across the base and defining a longitudinal slot in the base with an enlarged aperture;

a wear plate including a wear surface and a hold recessed below the wear surface, the wear plate moveable between a free condition off the base and an applied condition covering the base;

a nut having a blind bore, wherein the nut is applied to the base and translatable within the slot between a first position registered in the aperture and a second position offset from the aperture; and a key including an annular channel for carrying a gasket to prevent migration of debris into the bore;

wherein in the applied condition of the wear plate and the second position of the nut, the bore is registered with the slot and the hold to define a keyway, the nut is captured in the base, and the a key is applicable to the keyway for engagement with the nut to secure the wear plate on the base.

12. The wear plate of claim 11, wherein:

the nut is formed with threads; and the key is formed with threads complemental to the threads on the nut.

13. The wear plate of claim 11, wherein:

the nut is formed with two opposed shelves extending into the bore; and the key is formed with a shank having two opposed lobes and two opposed flat sides extending between the opposed lobes;

wherein the opposed flat sides of the key fit between the opposed shelves of the nut, the recesses fit between the opposed shelves of the nut, and the opposed lobes extend beyond the opposed shelves of the nut.

14. The wear plate of claim 11, wherein the slot has an overhanging lip, proximate the top of the base, which captures the nut when the nut is in the second position thereof.

15. The wear plate of claim 14, wherein the nut has a widened bottom which is in abutting contact with the overhanging lip when the nut is in the second position thereof.

16. The wear plate of claim 11, wherein the nut has a widened bottom with opposed sides that contact the slot to prevent rotation of the nut with respect to the base.

17. The wear plate of claim 11, wherein the key is rotated in a first direction to engage with the nut and is rotated in a second direction opposite the first direction to disengage with the nut.

18. The wear plate of claim 11, wherein, when the key is applied to the nut, the wear plate is in the applied condition, and the nut is in the second position, the key and the nut are prevented from separating from each other and from translating with respect to the base.

19. The wear plate of claim 11, wherein:

the wear plate has a wear body extending between the wear surface and an underside of the wear body, the wear body constructed from a wearable material; and the nut is disposed below the underside of the wear body when the wear plate is in the applied condition and the nut is in the second position.

20. The wear plate of claim 19, further comprising a seat at the bottom of the hold, the seat disposed below the underside of the wear body.

21. A method of installing a wear plate assembly comprising the steps of:

providing a base including a bottom, a top, and a longitudinal slot formed with an enlarged aperture;

fixing the bottom of the base to a work surface;

providing a nut having a widened bottom and an opposed blind bore;

passing the nut through the aperture and translating the nut through the slot to a position offset from the aperture, with the bottom of the nut proximate the bottom of the base and the bore of the nut directed toward the top of the base;

providing a wear plate including a wear surface and a hold recessed below the wear surface;

covering the base with the wear plate;

providing a key with an annular channel for carrying a gasket to prevent migration of debris into the bore; and applying the key to the hold, the slot, and the bore, and then engaging the key with the nut to secure the wear plate on the base.

* * * * *